US006685044B2

(12) United States Patent
Marcheselli et al.

(10) Patent No.: US 6,685,044 B2
(45) Date of Patent: Feb. 3, 2004

(54) REFUSE BIN WITH TILTABLE LID

(75) Inventors: Giuseppe Marcheselli, Cogozzo di Viadana (IT); Maurizio Marcheselli, Cogozzo di Viadana (IT)

(73) Assignee: Stil Casa S.N.C. di Marcheselli Angelo & C., Cogozzo di Viadana (IT)

( * ) Notice: Subject to any disclaimer, the term of this patent is extended or adjusted under 35 U.S.C. 154(b) by 120 days.

(21) Appl. No.: 09/977,677

(22) Filed: Oct. 16, 2001

(65) Prior Publication Data

US 2002/0053570 A1 May 9, 2002

(30) Foreign Application Priority Data

Nov. 6, 2000 (IT) ..... RE2000A0109

(51) Int. Cl.[7] ..... B65D 43/26
(52) U.S. Cl. ..... 220/263; 220/908
(58) Field of Search ..... 220/363, 260, 220/751, 481, 480, 476, 908, 3.3, 3.8, 3.9; 248/907, 95, 134, 147; 206/366

(56) References Cited

U.S. PATENT DOCUMENTS 1,121,388 A * 12/1914 Milks ..... 248/95
2,634,933 A * 4/1953 Grimsley ..... 248/129
5,413,243 A * 5/1995 Bemis et al. ..... 220/481
5,419,435 A * 5/1995 Perzan et al. ..... 206/366
5,492,238 A * 2/1996 Scholl et al. ..... 220/263
5,494,186 A * 2/1996 Marsh ..... 220/481
5,887,834 A * 3/1999 Gellos et al. ..... 248/156

* cited by examiner

*Primary Examiner*—Lee Young
*Assistant Examiner*—Lien Ngo
(74) *Attorney, Agent, or Firm*—Browdy and Neimark, P.L.L.C.

(57) ABSTRACT

Refuse bin with tiltable lid comprises a support member (1) to be secured at a fixed point spaced from the ground, and an upperly open refuse container (2) of virtually vertical longitudinal axis removably coupled to said support member on a transverse horizontal swing axis (333) such as to enable the container to automatically occupy a predetermined substantially erect non-use position in which it is closed by a respective lid, the lid being hinged to said support member on a horizontal axis (222) parallel to the preceding and being linked to the container in such a manner as to be opened and closed when said container swings about its swing axis in the direction in which it moves away from said substantially erect position, and in the opposite direction, respectively.

13 Claims, 4 Drawing Sheets

REFUSE BIN WITH TILTABLE LID

FIELD OF THE INVENTION

This invention relates to a refuse bin with tiltable lid, a typical but not exclusive use of which is in large community premises such as hospitals, and in places of intense pedestrian traffic such as railway stations, seaports and airports.

For such uses refuse bins are known comprising an outer container to be rested on the ground, a refuse container removably received in said outer container, and a swing lid which is hinged to the mouth of this latter and is opened by an operating pedal positioned at the base of the outer container, in a position distant from the position of the lid swing axis. In some cases the lid is opened by connection means interposed between the pedal and lid, and in others is opened by the refuse container itself which, following operation of the pedal, rises from the bottom of the outer container and pushes against the lower face of the lid.

Such known refuse bins have proved unsatisfactory for the following reasons.

They are particularly complicated and costly because of the presence of the two containers, the pedal and its accessories, and because of the need to provide seats for said pedal and accessories. They have also proved to be of relatively poor reliability or durability precisely because of said complexity.

SUMMARY OF THE INVENTION

The main object of the present invention is to provide a refuse bin with tiltable lid able to overcome the aforesaid drawbacks. Said object is attained by a refuse bin presenting the characteristics indicated in the claims.

It comprises a support member intended to be secured at a fixed point spaced from the ground, and an upperly open refuse container of virtually vertical longitudinal axis removably coupled to said support member on a transverse horizontal swing axis such as to enable the container to automatically occupy a predetermined substantially erect non-use position in which it is closed by a respective lid, the lid being hinged to said support member on a horizontal axis parallel to the preceding and being linked to the container in such a manner as to be opened and closed when said container swings about its swing axis in the direction in which it moves away from said substantially erect position, and in the opposite direction, respectively.

Preferably said swing axis is situated in the upper front region of the container such that the weight of this latter generates a straightening moment which forces it towards said substantially erect position.

The lid is opened by the intervention of the user, for example by resting a shoe against the lower front part of the container, whereas it is closed by said straightening moment.

The means providing said linkage between the lid and container are advantageously formed in such a manner as to enable the lid to assume a stable position of complete opening when the container is removed from its support, for example to be emptied.

All the objects of the invention are attained by virtue of the aforedescribed solution.

In this respect, firstly the proposed solution is particularly simple and economical, seeing that it comprises only a small number of elements connected together in a very simple manner for operational purposes, as will be seen.

It is also particularly reliable or durable by virtue of the said constructional simplicity.

The characteristics and constructional merits of the invention will be apparent from the ensuing detailed description given with reference to the figures of the accompanying drawings, which illustrate a particular preferred embodiment thereof by way of non-limiting example.

DESCRIPTION OF THE PREFERRED EMBODIMENT

Figure 1:
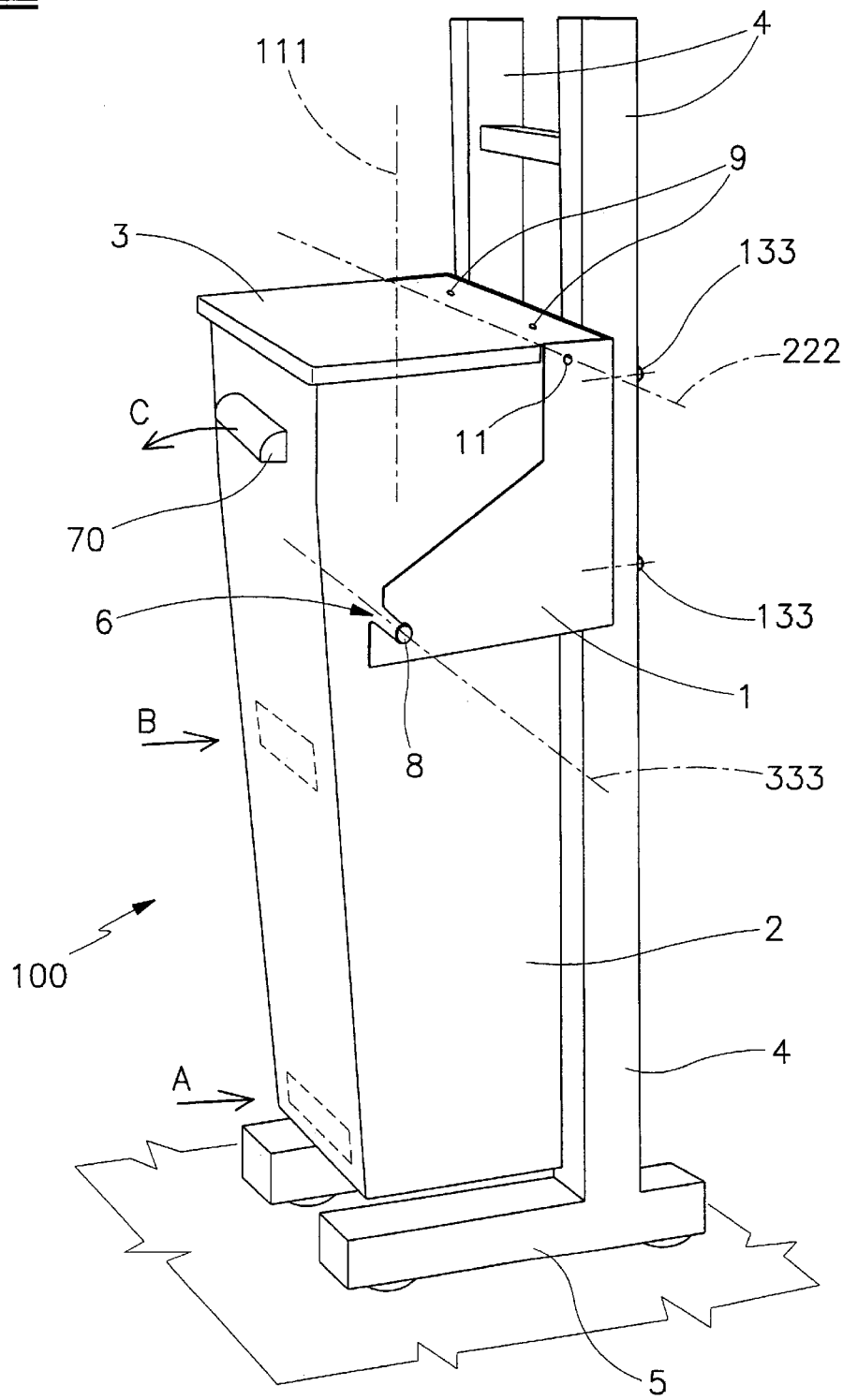
FIG. 1 is a perspective view showing a refuse bin of the invention in its closed configuration, in the movable location version.
Figure 2:
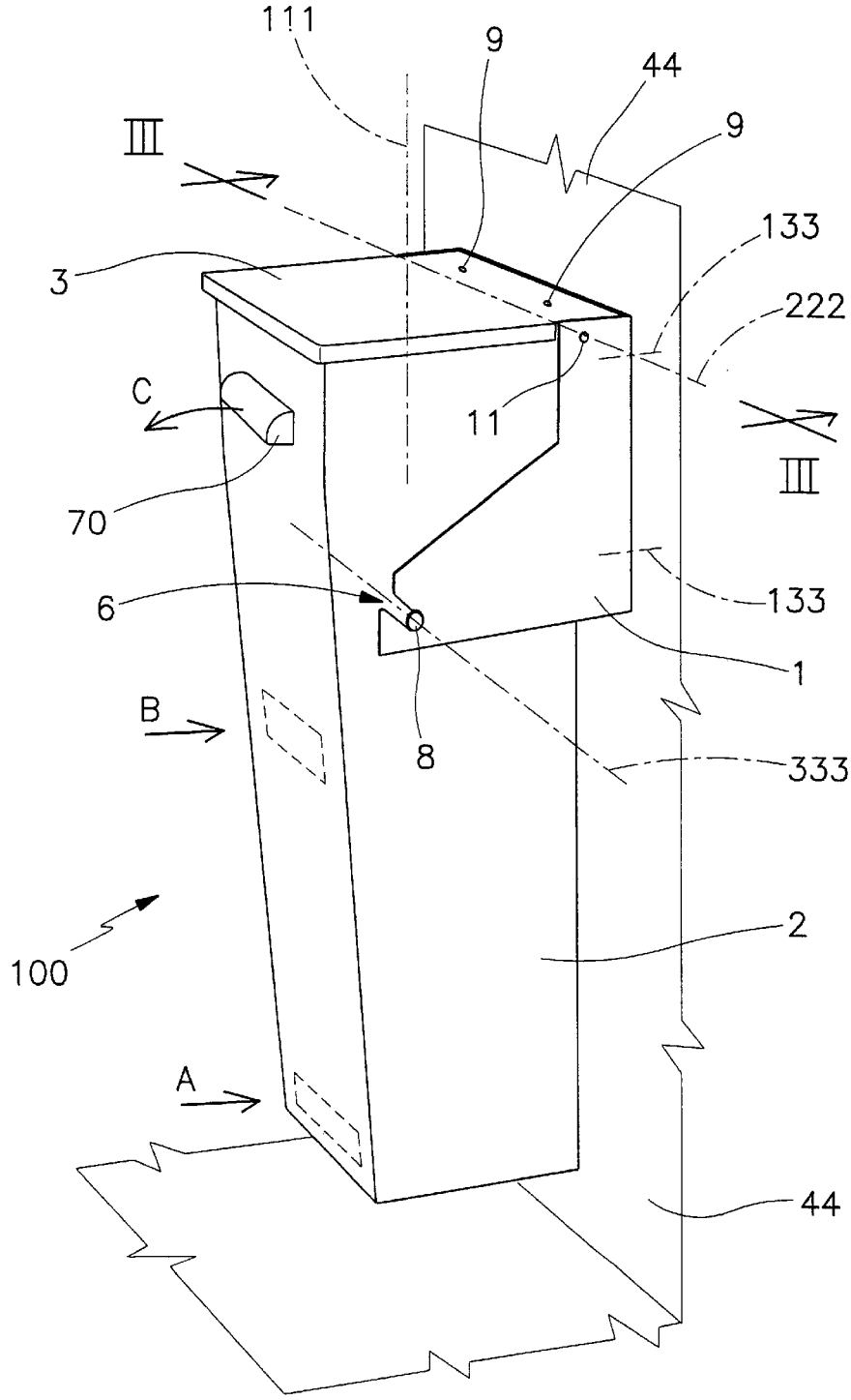
FIG. 2 is a view similar to the preceding, but showing the refuse bin in the fixed location version.

From said figures, and in particular FIGS. 1 and 2, it can be seen that the refuse bin of the invention, indicated overall by the reference numeral 100, comprises essentially a support member 1 intended to be fixed to a substantially vertical surface, an upperly open refuse container 2 with its longitudinal axis 111 substantially vertical when in the illustrated rest configuration, and a lid 3 of tiltable type hinged at its rear to said member, in the manner to be described.

The said elements are constructed of a suitable material, typically a rigid synthetic material.

In plan view, said support member 1 has the shape of a thin U-piece with its crosspiece provided with fixing means 133, and its arms embracing the sides of the container 2 virtually as an exact fit (see FIG. 3) and extending beyond the axis 111 of this latter where they present two aligned recesses 6 for its suspension.

Said means 133 consist of bolts if the refuse bin 100 is positioned on a vertical frame 4 provided with a floor support base 5 (see FIG. 1), or of expansion plugs if mounted on a wall 44 (see FIG. 2).

Said recesses 6 are inclined upwards towards the front part of the refuse bin 100 and have their openings suitably flared.

In the illustrated embodiment the container 2 has a slightly downwardly tapering frusto-pyramidal shape of rectangular cross-section, however it can be of other shapes, for example substantially cylindrical. The front edge of the mouth of the container 2 is provided with a soft impact protection bar 7, below which there is an outer central lifting handle 70.

At the upper front regions of the sides of the container 2 there are provided two external coaxial pins 8 with an enlarged terminal head, which engage said recesses 6 to define the transverse horizontal swing axis 333 of the container 2.

The lid 3 presents a descending peripheral rim extending along the entire front edge and along the two side edges with the exception of a rear end portion as shown in FIGS. 3 to 6.

At the top of the side walls of the container 2 there are two recesses in positions corresponding with said rear end portions.

A channel piece 10 is fixed to the underside of the rear part of the lid 3 in a position corresponding with said recesses, using the threaded means indicated by 9 or the like, and extends along the entire width with its longitudinal opening facing the container 2.

Figure 3:
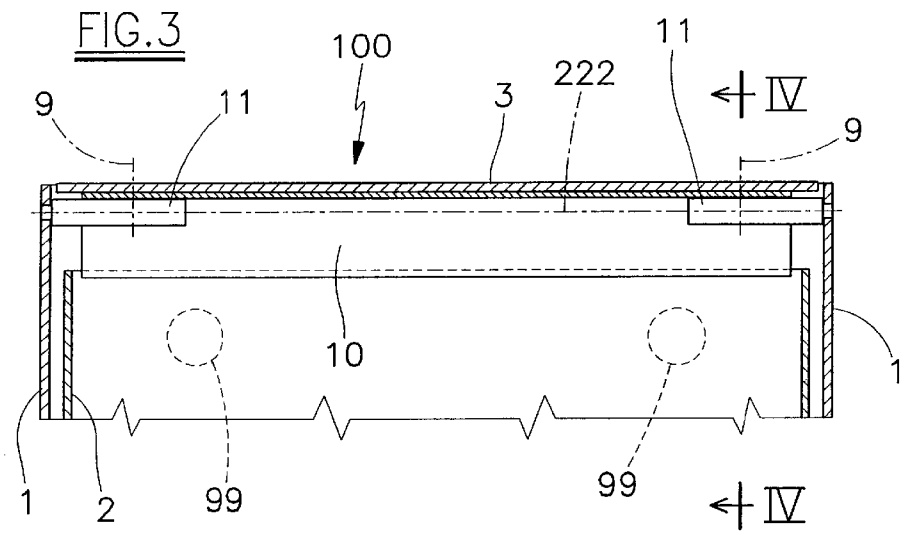
FIG. 3 shows a part of the section III—III of FIG. 2 on an enlarged scale.
Figure 6:
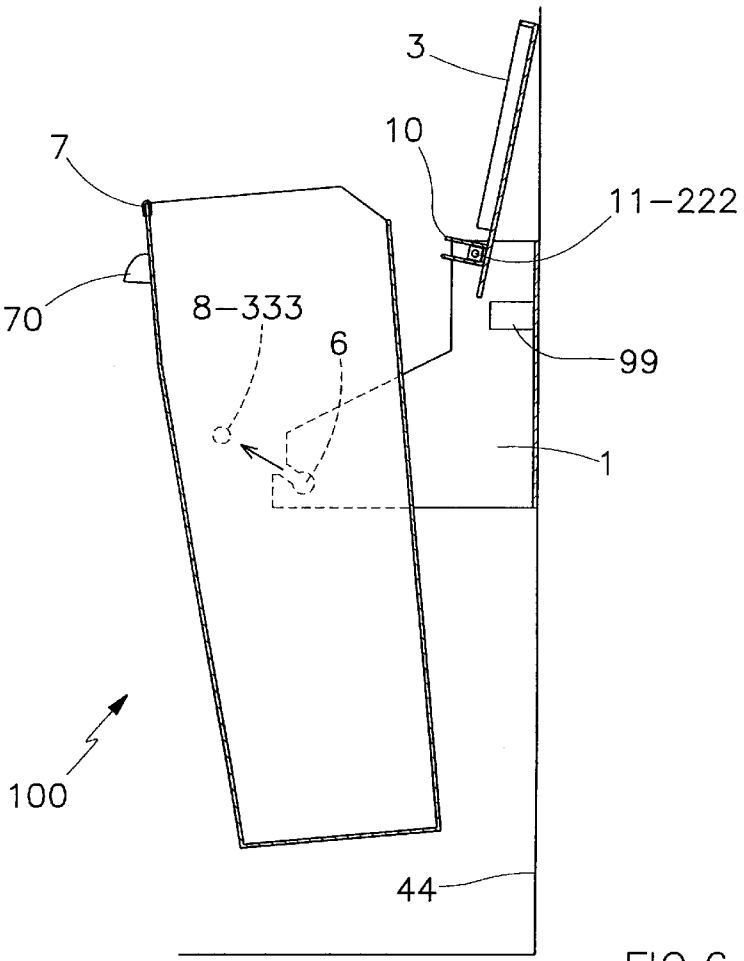
FIG. 6 is a view similar to the preceding, but showing the lid in the stable maximum opening position which it attains on releasing the refuse container from the support member.
Figure 5:
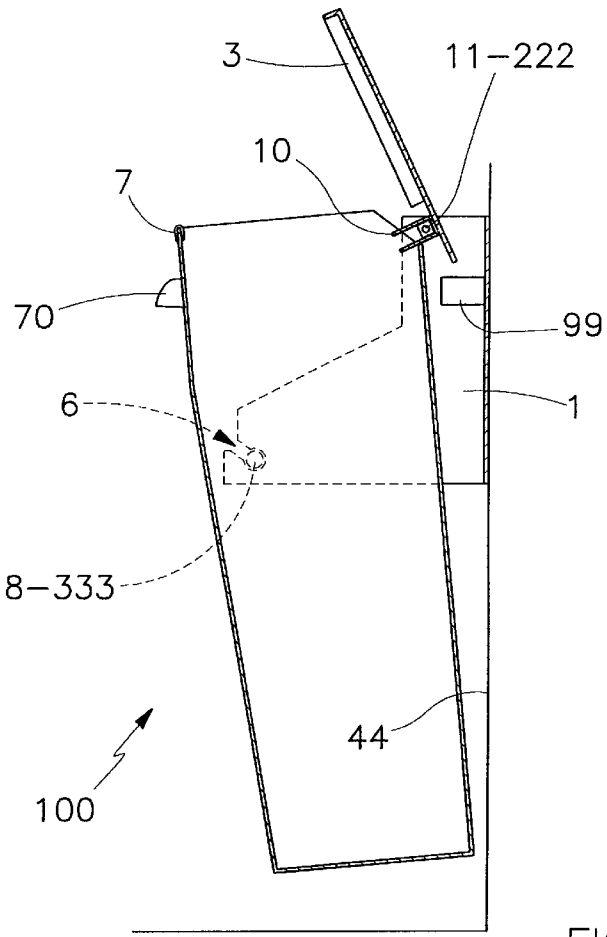
FIG. 5 is a view similar to the preceding, but with the lid shown in the raised position enabling refuse to be inserted.

Into the opposing ends of said channel piece 10 there are inserted, and locked therein by said means 9, two identical square bars 11 which project beyond the sides of the container 2 in the form of respective pins which are received in matching holes provided in the arms of the member 1 (see FIG. 3).

The said bars 11 define the horizontal hinging axis 222 of the lid 3, the swinging movements of which derive from the swinging movements of the container 2 about its suspension and hinging axis 333.

For this purpose the rear wall of the channel piece 10 is conveniently spaced from the rear edge of the lid 3, within the dihedral defined in this manner there being received the upper edge of the rear wall of the container 2.

Figure 4:
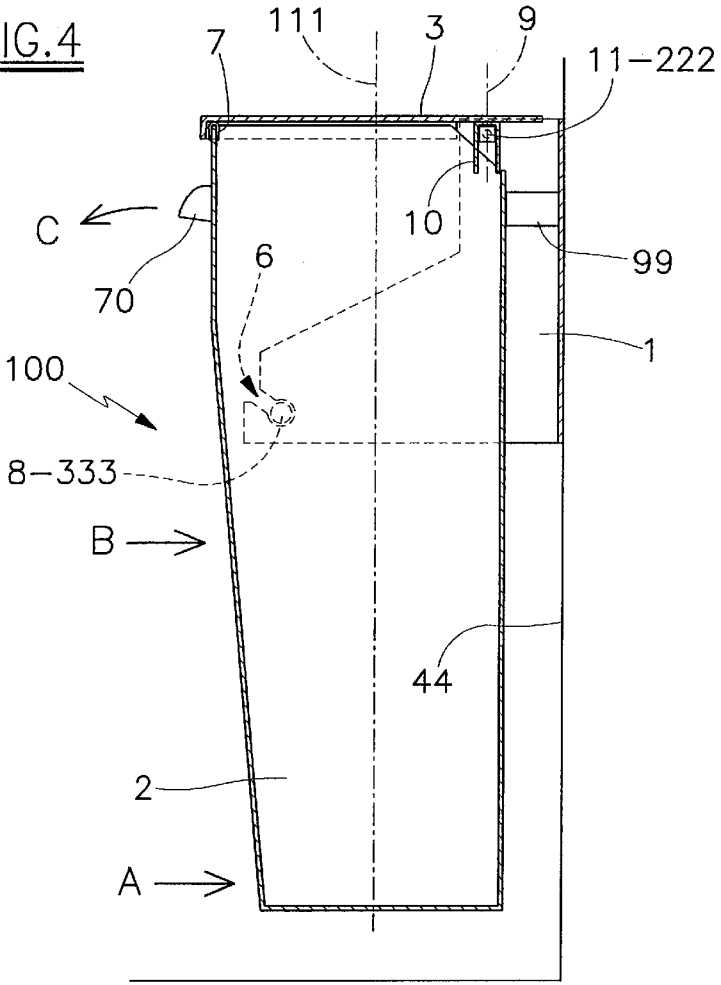
FIG. 4 is the section IV—IV of FIG. 3 on a decreased scale.

With reference to FIG. 4, when the container 2 is freely hanging on the recesses 6 with the lid 3 closed, the front face of the upper edge of the rear wall of the container 2 is practically in contact with the rear side of the channel piece 10, the said rear wall rests against rear soft impact protection blocks 99 fixed to the crosspiece of the member 1, and the rear edge of the lid 3 is slightly spaced from the said crosspiece.

Said configuration is due to the off-centered position of the hinging and suspension axis of the container 2 with respect to its own longitudinal axis 111, by virtue of which its weight (plus the weight of any refuse contained therein) generates a straightening moment which thrusts the top of the container 2 towards the member 1 and towards the blocks 99, whereas the lower end of the rear wall of the container 2 is spaced from the vertical surface defined by the connection elements 4 or 44.

To raise the lid without touching it with the hand, it is necessary merely to overcome said straightening moment, for which the user has various possibilities.

Either he pushes with a foot against the lower end of the front wall of the container 2 as indicated by the arrow A in FIGS. 1, 2 and 4, or he pushes with a knee against the central part of the front wall as indicated by the arrow B, or he pulls the handle 70 in the direction of the arrow C. As a result of said pushing or pulling action the container 2 is forced to swing in the opposite direction to said straightening moment, with simultaneous swing of the lid 3 about its axis 222 as a result of the thrust of the upper rear edge of the container against the channel piece 10. The maximum swing of the container 2 is determined by the distance between the base of the container 2 and the surface 4 or 44 on which the member 1 is fixed, said maximum swing resulting in a corresponding lid rotation of less than 90° (see FIG. 5).

When said thrusting or pulling action is halted, the container 2 straightens by itself and the lid 3 follows it to close.

When the container 2 is to be emptied, it is unhooked from the recesses 6, causing complete opening of the lid 3, which then rests against said surface 4 or 44 with the lower generators of the channel piece 10 lying outside the trajectory followed by the upper generators of the upper rear edge of the container 2.

During the said operation the rear edge of the lid 3 swings downwards along said trajectory followed by the rear upper edge of the container 2, so that when this latter is next hooked on, the lid 3 automatically closes. The merits and advantages of the invention are apparent from the aforegoing and from an examination of the accompanying figures. The invention is not limited to that illustrated and described, but covers all technical equivalents of the invention and their combinations, if implemented within the context of the following claims.

What is claimed is:

1. A refuse bin with tiltable lid comprising a container having an upper mouth, the container being removably coupled to a support member; the lid being hinged to said support member and tiltable between a closed position in which it closes the container mouth and an open position in which the lid is raised away from the container mouth, wherein the lid comprises a downwardly directed appendix inserted in the container mouth in the closed position; the container being rotatably engaged to the support member on a fixed horizontal swing axis; wherein when the container is rotated about said swing axis the container mouth acts on the appendix of the lid and raises the lid to the open position.

2. A refuse bin as claimed in claim 1, wherein said support member comprises an U-shaped body comprising a crosspiece, and two parallel arms for embracing said container, said arms being provided with aligned recesses.

3. A refuse bin as claimed in claim 2, wherein said recesses are inclined upwards towards a front part of the refuse bin.

4. A refuse bin as claimed in claim 2, wherein at least one rear impact protection block is fixed to said crosspiece and placed between said crosspiece and said container.

5. A refuse bin as claimed in claim 2, wherein said swing axis is positioned in an upper front part of the container.

6. A refuse bin as claimed in claim 1, wherein said swing axis is defined by two coaxial pins branching from sides of the container and provided with a terminal head, said heads being received in said recesses.

7. A refuse bin as claimed in claim 1, wherein said appendix extends from a lower face of a rear edge of the lid, and is inserted into the container mouth.

8. A refuse bin as claimed in claim 7, wherein a hinging axis of the lid runs through said appendix.

9. A refuse bin as claimed in claim 8, wherein said appendix is located to cause the lid to tilt rearwards into a stable off-vertical position when the container is unhooked from the support member.

10. A refuse bin as claimed in claims 7 and 8, wherein the rear edge of the lid projects beyond said appendix to define a stop against which an upper rear edge of the container rests when hooked onto the support member with simultaneous closure of the lid.

11. A refuse bin as claimed in claim 1, wherein the container is provided with at least one lifting and transporting handle.

12. A refuse bin as claimed in claim 1, wherein said support member is provided with fixing means for supporting it on a wall.

13. A refuse bin as claimed in claim 1, wherein said support member is provided with fixing means for mounting it on a vertical frame with a floor support base.

* * * * *